US011848510B2

(12) United States Patent
Fassmann et al.

(10) Patent No.: US 11,848,510 B2
(45) Date of Patent: Dec. 19, 2023

(54) METHOD FOR PRODUCING A CONTACT PLUG, AND CONTACT PLUG

(71) Applicant: Phoenix Contact GmbH & Co. KG, Blomberg (DE)

(72) Inventors: Dennis Fassmann, Hameln (DE); Maik Dahnke, Steinheim (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 532 days.

(21) Appl. No.: 16/966,913

(22) PCT Filed: Feb. 11, 2019

(86) PCT No.: PCT/EP2019/053287

§ 371 (c)(1),
(2) Date: Aug. 3, 2020

(87) PCT Pub. No.: WO2019/158473

PCT Pub. Date: Aug. 22, 2019

(65) Prior Publication Data

US 2021/0050685 A1 Feb. 18, 2021

(30) Foreign Application Priority Data

Feb. 14, 2018 (BE) ..... 2018/5090

(51) Int. Cl.
*H01R 13/03* (2006.01)
*H01R 43/16* (2006.01)

(52) U.S. Cl.
CPC ..... *H01R 13/03* (2013.01); *H01R 43/16* (2013.01)

(58) Field of Classification Search
CPC ..... H01R 13/03; H01R 43/16
USPC ..... 174/68.1
See application file for complete search history.

(56) References Cited

U.S. PATENT DOCUMENTS 6,492,060 B1 * 12/2002 Timmons ..... H01R 11/281 429/178
2011/0207363 A1 * 8/2011 Shimizu ..... H01R 43/16 29/874

FOREIGN PATENT DOCUMENTS

| | | | | |
|---|---|---|---|---|
| DE | 202008014774 U1 | | 3/2009 | |
| EP | 2937943 A1 | * | 10/2015 | ..... H01R 13/18 |
| EP | 2937943 A1 | | 10/2015 | |
| EP | 2830158 B1 | * | 12/2017 | ..... C22C 9/00 |
| JP | 2009054374 A | * | 3/2009 | ..... H01R 13/111 |
| JP | 2012221774 A | * | 11/2012 | ..... H01R 13/11 |
| JP | 2012221774 A | | 11/2012 | |
| JP | 2016035858 A | * | 3/2016 | ..... H01R 43/16 |
| KR | 101692671 B1 | * | 1/2017 | ..... B23P 13/02 |

* cited by examiner

*Primary Examiner* — Peter G Leigh
(74) *Attorney, Agent, or Firm* — LEYDIG, VOIT & MAYER, LTD.

(57) ABSTRACT

A process for producing a contact plug includes: providing a blank made of a lead-free brass alloy; semihot forming a first section of the blank to form a crimping region, the crimping region having an opening for insertion of a conductor end and the first section of the blank being heated to a semihot forming temperature before and/or during the semihot forming; and cold forming a second section of the blank to form a plugging region, the plugging region having a plurality of lamellae.

11 Claims, 2 Drawing Sheets

METHOD FOR PRODUCING A CONTACT PLUG, AND CONTACT PLUG

CROSS-REFERENCE TO PRIOR APPLICATIONS

This application is a U.S. National Phase application under 35 U.S.C. § 371 of International Application No. PCT/EP2019/053287, filed on Feb. 11, 2019, and claims benefit to Belgian Patent Application No. BE 2018/5090, filed on Feb. 14, 2018. The International Application was published in German on Aug. 22, 2019 as WO 2019/158473 under PCT Article 21(2).

FIELD

The present invention relates to a process for producing a contact plug and also to a contact plug.

BACKGROUND

Contact plugs are usually produced by cutting machining of lead-containing copper and brass alloys. The cutting machinability of blanks is improved in this case by alloying-in of lead. Due to the demonstrably harmful effect of lead on human health, the use of lead is increasingly restricted by standards.

Fundamentally, the challenge in the production of contact plugs which have a crimp connection is to provide a material which is firstly readily able to be worked by cutting machining and secondly has a sufficiently high cold deformability in order to produce durable, crack-free crimp connections in a reliable manner. This compromise is at present achieved by lead-containing copper or brass alloys which are firstly readily able to be worked by cutting machining and are also crimpable without crack formation.

In the case of lead-free brass alloys, such a compromise between good cutting machinability, i.e. brittle-hard behavior, and crimpability, which requires high ductility, has not been able to be achieved in a practical way. Thus, crimp connections made of brass alloys have a tendency to form cracks.

Furthermore, the cutting machining of lead-free brass alloys requires high cutting forces which can usually be achieved in a process-reliable way only by means of cooled drills, which leads to increased manufacturing costs. In addition, manufacturing by cutting machining suffers in principle from the disadvantage that a loss of up to 50% of material has to be accepted.

SUMMARY

In an embodiment, the present invention provides a process for producing a contact plug, comprising: providing a blank which comprises a lead-free brass alloy; semihot forming a first section of the blank to form a crimping region, the crimping region having an opening for insertion of a conductor end and the first section of the blank being heated to a semihot forming temperature before and/or during the semihot forming; and cold forming a second section of the blank to form a plugging region, the plugging region having a plurality of lamellae.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
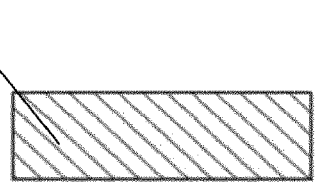
FIG. 1 provision of a blank.

In an embodiment, the present invention provides a process for producing a contact plug and also providing a contact plug, which process and plug do not have the above-described disadvantages or at least have them to a decreased extent and, in particular, make possible a lead-free contact plug which in a crimping region provides a sufficiently high and in particular crack-free deformability.

The above-described, technical problem is solved in each case by a process as described herein and a contact plug as described herein. Further embodiments of the process can be derived from the description below.

In a first aspect, the invention provides a process for producing a contact plug, comprising the process steps: provision of a blank which comprises a lead-free brass alloy or consists of a lead-free brass alloy; semihot forming of a first section of the blank to form a crimping region, where the crimping region has an opening for insertion of a conductor end and the first section of the blank is heated to a semihot forming temperature before and/or during the semihot forming; cold forming of a second section of the blank to form a plugging region, where the plugging region has a plurality of lamellae.

Due to the temperature conditions indicated, the crimping region is provided with a microstructure which has low work hardening and thus great ductility for a crimping operation. Thus, it is possible to carry out reliable crimping of a conductor end with the crimping region, without crack formation occurring in the region of the crimped join.

The cold forming of the plugging region leads to work hardening, so that the plugging region is not plastically deformed, or plastically deformed to only a small extent, during production of a plug connection and is critically elastically deformed in order to reversibly provide appropriate spring forces.

The above listing of the process steps does not prescribe a necessary order of the process steps. Thus, the process steps can be carried out in the order listed, or in a different order. For example, it can be provided, deviating from the order of the listing, for cold forming of the second section to be carried out before the semihot forming of the first section.

In a further embodiment of the process, the semihot forming temperature is in a range from 250° C. inclusive to 450° C. inclusive. Thus the semihot forming temperature can be, for example, 350° C.

When cold forming is spoken of in the present text, this is forming at a temperature below the semihot forming temperature.

Cold forming can take place at a temperature of less than 100° C., in particular take place at a temperature of less than 50° C., more particularly take place at room temperature in a range from 15° C. to 30° C.

It goes without saying that the specified temperatures denote the material temperature of the component to be formed. The ambient temperature can differ therefrom and can be, for example, 25° C.

In a further embodiment of the process, the second section can be cooled before and/or during the cold forming of the second section. This can prevent, for example, introduction of heat from a preceding semihot forming step from leading to heating of the second section to above an intended cold forming temperature.

As an alternative or in addition, the first section can be cooled before and/or during the cold forming of the second section. In this way, the first section can, for example, have been heated from a preceding semihot forming step, with heat flow into the second section being avoided or reduced by means of the cooling.

In a further embodiment of the process, the second section can be cooled before and/or during and/or after the heating of the first section. As an alternative or in addition, it can be provided for the temperature of the second section before and/or during and/or after the forming of the first and second section to be below 100° C., in particular below 50° C., in particular at room temperature in a range from 15° C. to 30° C., at all times.

The expression "at all times" here relates to the duration of the production process in question.

Cooling of the first and/or second section can ensure that the desired work hardening is established in the second section despite heating of the first section.

A further embodiment of the process is characterized in that a subregion of the crimping region formed by semihot forming is cold formed after the semihot forming. Thus, for example, an end section of the crimping region can be shaped to give a circumferential collar which as a result of work hardening locally has a higher strength than the adjoining part of the crimping region.

The lamellae can be axially projecting spring webs. As an alternative or in addition, the lamellae can be arranged at equidistant angle spacings around a central opening. As an alternative or in addition, axial slits can be formed between the lamellae. A reliable plug connection can be provided by means of the lamellae.

In a further embodiment of the process, cooling is carried out by means of a cooling device held on a pressing tool or integrated into a pressing tool. As an alternative or in addition, heating is carried out by means of a heating device held on a pressing tool or integrated into a pressing tool, for example an induction heating device, a resistance heating device or the like. In this way, cooling and/or heating device can be integrated in a compact manner in a pressing tool and be employed when required.

Forming, i.e. both hot forming and cold forming, can be carried out by means of a multistage press, where the multistage press has at least one heating device and at least one cooling device. As stated above, a heating and cooling device can be integrated into tools of the multistage press.

In a second aspect, the invention provides a contact plug which comprises a lead-free brass alloy or consists of a lead-free brass alloy, having a crimping region, where the crimping region has an opening for inserting a conductor end, and having a plugging region, where the plugging region has a plurality of lamellae, where the crimping region has, at least in sections, a lower degree of work hardening than the plugging region. In this way, it is possible to achieve firstly good crimpability of the crimping region and also satisfactory strength and stiffness of the lamellae. It goes without saying that comparison of the work hardening of the crimping region with that of the plugging region is a comparison made before actual crimping of a conductor end in the crimping region.

It can be provided for the contact plug to have been produced by a process according to the invention.

The contact plug can comprise a lead-free brass alloy CuZn36, CuZn30, CuZn20, CuZn15 or CuZn5 or consist of a lead-free brass alloy CuZn36, CuZn30, CuZn20, CuZn15 or CuZn5.

A process according to the invention for producing a contact plug will firstly be described below with reference to FIGS. 1-5. A contact plug 2 produced by the process of the invention is depicted in FIG. 6.

To produce the contact plug 2, a blank 4 which consists of a lead-free brass alloy is firstly provided.

After provision of the blank 4, a first section 6 of the blank 4 is shaped by semihot forming to form a crimping region 6. An opening 10 for insertion of a conductor end is formed on the crimping region 6 by means of a tool 8. The first section 6 is in the present case heated to a semihot forming temperature of 350° C. by means of an induction heating device 12 before and during the semihot forming.

During the substep of semihot forming of the first section 6, a second section 14 of the blank 4 is actively cooled by means of a cooling device 16. The cooling device 16 has cooling channels 18 which convey a cooling fluid.

Figure 3:
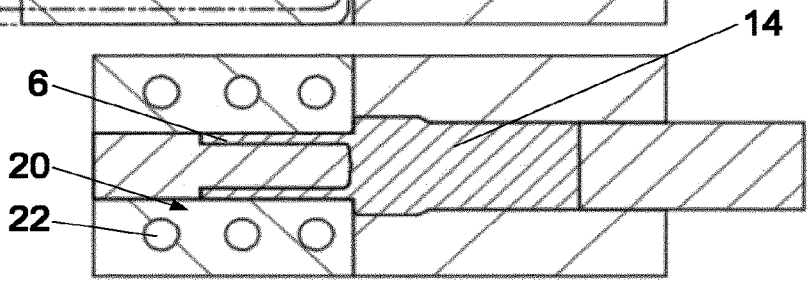
FIG. 3 cold forming of a second section of the blank.

Cold forming as depicted in FIG. 3 of the second section 14 is subsequently carried out, with the first section 6 being cooled by means of a cooling device 20, which has cooling channels 22 for conveying a cooling fluid, during the cold forming of the second section 14.

Figure 2:
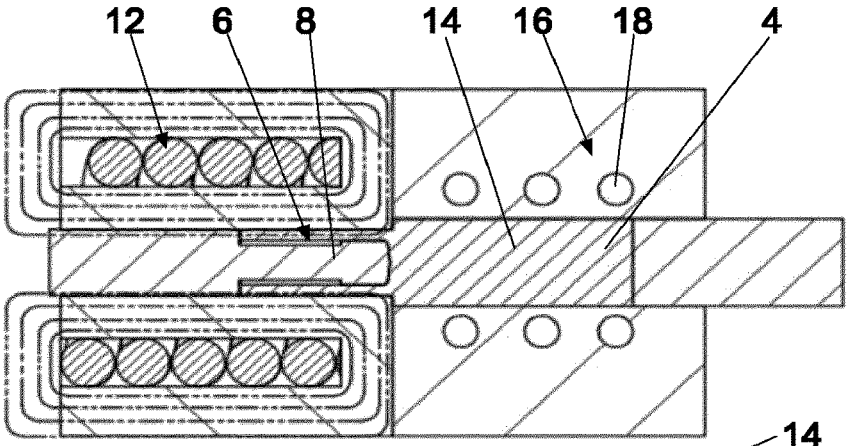
FIG. 2 semihot forming of a first section of the blank.

As can be seen from FIGS. 2 and 3, the heating device 12 and the cooling devices 16, 22 are integral constituents of tools which enclose the blank 4 during forming.

Figure 4:
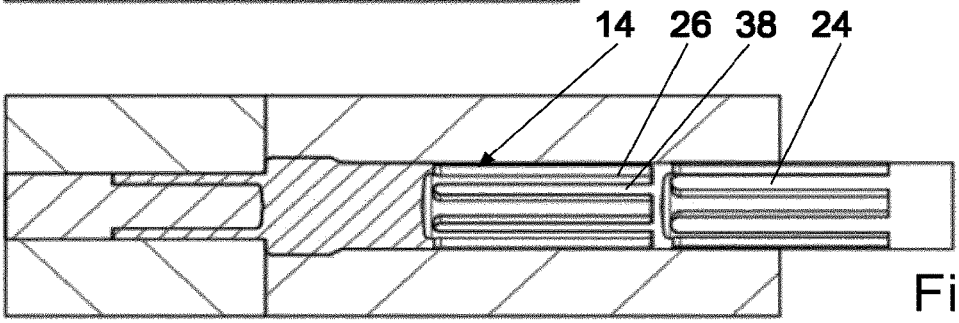
FIG. 4 further cold forming of the second section.

FIG. 4 shows a further cold forming of the second section 14 to produce a plugging region 14, where lamellae 26 are formed on the second section 14 using a tool 24.

The lamellae 26 are axially projecting spring webs which are arranged at equidistant angle spacings around a central opening. Axial slits 38 are in the present case formed between the lamellae 26.

Figure 5:
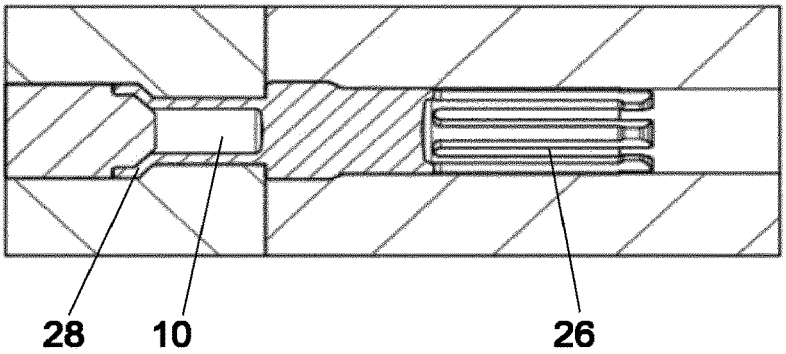
FIG. 5 cold forming of an end section of the first section.
Figure 6:
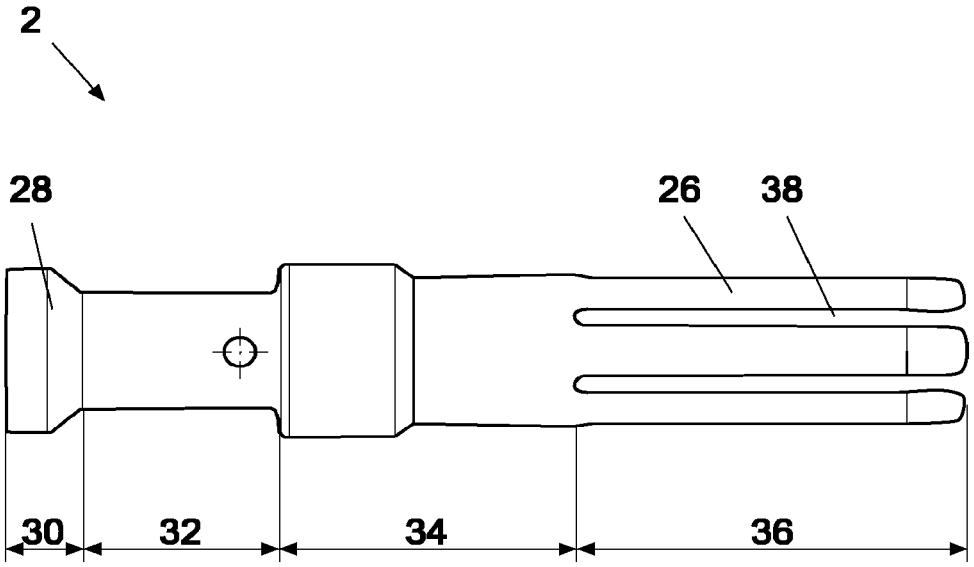
FIG. 6 a contact plug according to the invention.

In a last forming step, a subregion 28 of the crimping region 6 formed by semihot forming is cold formed as shown in FIG. 5. The region 28 forms a circular circumferential collar 28.

A first longitudinal section 30 of the contact plug 2 is provided with a work hardened region (cf FIG. 6) which is adjoined by a longitudinal section 32 which has a lower degree of work hardening and forms a ductile crimping region by means of the inventive production process described with reference to FIGS. 1-5. Along the longitudinal section 34, the strength of the contact plug 2 corresponds essentially to that of the blank 4 originally provided. Along the longitudinal region 36, in which the lamellae 26 have been formed by cold forming, the work hardening is greatest since the greatest degrees of deformation have been brought about here.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

2 Contact plug
4 Blank
6 First section/crimping region
8 Tool
10 Opening
12 Induction heating device
14 Second section/plugging region
16 Cooling device
18 Cooling channel
20 Cooling device
22 Cooling channel
24 Tool
26 Lamellae
28 Subregion/circumferential collar of the crimping region 6
30 Longitudinal section
32 Longitudinal section
34 Longitudinal section
36 Longitudinal section
38 Slit

The invention claimed is:

1. A process for producing a contact plug, comprising:
providing a blank which comprises a lead-free brass alloy;
semihot forming a first section of the blank to form a crimping region, the crimping region having an opening for insertion of a conductor end and the first section of the blank being heated to a semihot forming temperature before and/or during the semihot forming; and
cold forming a second section of the blank to form a plugging region, the plugging region having a plurality of lamellae,
wherein a subregion of the crimping region formed by semihot forming is cold formed after the semihot forming.

2. The process of claim 1, wherein the semihot forming temperature is in a range from 250° C. inclusive to 450° C. inclusive.

3. The process of claim 1, wherein the second section is cooled before and/or during the cold forming of the second section, and/or the first section is cooled before and/or during the cold forming of the second section.

4. The process of claim 1, wherein the second section is cooled before and/or during and/or after the heating of the first section, and/or a temperature of the second section before and/or during and/or after the forming of the first and second section is below 100° C. at all times.

5. The process of claim 1, wherein the lamellae comprise axially projecting spring webs, and/or
the lamellae are arranged at equidistant angle spacings around a central opening, and/or
axial slits are formed between the lamellae.

6. The process of claim 1, wherein cooling is carried out by a cooling device held on a pressing tool or integrated into a pressing tool, and/or
heating is carried out by a heating device held on a pressing tool or integrated into a pressing tool.

7. The process of claim 6, wherein the heating device comprises an induction heating device or a resistance heating device.

8. The process of claim 1, wherein forming is carried out by a multistage press, the multistage press having at least one heating device and at least one cooling device.

9. A contact plug, comprising:
a lead-free brass alloy having a crimping region with an opening for inserting a conductor end and a plugging region having a plurality of lamellae,
wherein the crimping region has, at least in sections, a lower degree of work hardening than the plugging region, and
wherein a subregion of the crimping region formed by semihot forming is cold formed after the semihot forming.

10. The contact plug of claim 9, wherein the contact plug has been produced by a process comprising:
providing a blank which comprises a lead-free brass alloy;
semihot forming a first section of the blank to form a crimping region, the crimping region having an opening for insertion of a conductor end and the first section of the blank being heated to a semihot forming temperature before and/or during the semihot forming; and
cold forming a second section of the blank to form a plugging region, the plugging region having a plurality of lamellae, and/or
wherein the contact plug comprises a lead-free brass alloy CuZn36, CuZn30, CuZn20, CuZn15, or CuZn5.

11. A process for producing a contact plug, comprising:
providing a blank which comprises a lead-free brass alloy;
semihot forming a first section of the blank to form a crimping region, the crimping region having an opening for insertion of a conductor end and the first section of the blank being heated to a semihot forming temperature before and/or during the semihot forming; and
cold forming a second section of the blank to form a plugging region, the plugging region having a plurality of lamellae,
wherein the second section is cooled before and/or during the cold forming of the second section, and/or the first section is cooled before and/or during the cold forming of the second section.

* * * * *